US005195344A

United States Patent [19]

Masuda et al.

[11] Patent Number: 5,195,344

[45] Date of Patent: Mar. 23, 1993

[54] WARM ROLLING FACILITY FOR STEEL STRIP COILS

[75] Inventors: Sadakazu Masuda; Fumio Fujita; Tadayoshi Murakami; Masahiko Yoshino; Ryuichi Yagi; Masamoto Kamata, all of Tokyo, Japan

[73] Assignee: Nippon Kokan Kabushiki Kaisha, Tokyo, Japan

[21] Appl. No.: 811,884

[22] PCT Filed: May 23, 1988

[86] PCT No.: PCT/JP88/00489

§ 371 Date: Dec. 15, 1988

§ 102(e) Date: Dec. 15, 1988

Related U.S. Application Data

[63] Continuation of Ser. No. 584,364, Sep. 17, 1990, abandoned, which is a continuation of Ser. No. 294,610, Dec. 15, 1988, abandoned.

[51] Int. Cl.[5] ..... B21B 27/06

[52] U.S. Cl. ..... 72/202; 72/200

[58] Field of Search ..... 72/128, 146, 148, 200, 72/202, 236; 148/111

[56] References Cited

U.S. PATENT DOCUMENTS

| | | | |
|---|---|---|---|
| 1,912,129 | 5/1933 | Detwiler | 72/202 X |
| 2,088,241 | 7/1937 | Irvin | 72/202 |
| 2,376,240 | 5/1945 | Ferm . | |
| 2,658,741 | 11/1953 | Schmidt et al. | 72/200 X |
| 3,606,778 | 9/1971 | Bomberger | 72/202 |
| 3,613,425 | 10/1971 | Roberts | 72/202 |
| 3,616,669 | 11/1971 | Shumaker . | |
| 4,291,558 | 9/1981 | Santali et al. | 72/202 |
| 4,580,428 | 4/1986 | Brettbacher et al. | 72/226 |
| 4,938,049 | 7/1990 | Masuda et al. | 72/202 |

FOREIGN PATENT DOCUMENTS

| | | | |
|---|---|---|---|
| 0061441 | 9/1982 | European Pat. Off. . | |
| 702241 | 1/1941 | Fed. Rep. of Germany . | |
| 2629440 | 1/1978 | Fed. Rep. of Germany . | |
| 703514 | 9/1931 | France . | |
| 50-75155 | 6/1975 | Japan . | |
| 51-129850 | 11/1976 | Japan . | |
| 55-20962 | 2/1980 | Japan . | |
| 57-4306 | 1/1982 | Japan . | |
| 58-171531 | 10/1983 | Japan . | |
| 58-196115 | 11/1983 | Japan . | |
| 59-191502 | 10/1984 | Japan | 72/202 |
| 61-17202 | 1/1986 | Japan . | |
| 61-165206 | 7/1986 | Japan . | |
| 62-101617 | 5/1987 | Japan . | |
| 63-180311 | 7/1988 | Japan . | |
| 1-053706 | 3/1989 | Japan . | |
| 605649 | 5/1978 | U.S.S.R. | 72/202 |
| 240082 | 9/1925 | United Kingdom . | |

*Primary Examiner*—Lowell A. Larson
*Assistant Examiner*—Michael J. McKeon
*Attorney, Agent, or Firm*—Nields & Lemack

[57] ABSTRACT

The present invention relates to a warm rolling facility suited to rolling of brittle strip coils such as high Si steels. The facility is provided with a rolling machine, tension reels disposed respectively at an inlet side and an outlet side of the rolling machine, deflector rolls between each of the tension reels and the rolling machine. The tension reels are positioned in warming furnaces having heating means, and the rolls and the deflector rolls are provided with means for heating the rolls. Further, the rolling machine is provided at its inlet and outlet with heating apparatuses for heating the strip.

10 Claims, 3 Drawing Sheets

WARM ROLLING FACILITY FOR STEEL STRIP COILS

This is a continuation of application Ser. No. 584,364, filed Sep. 17, 1990, now abandoned, which is a continuation of application Ser. No. 294,610 filed Dec. 15, 1988, now abandoned.

TECHNICAL FIELD

The present invention relates to a warm rolling facility suitable to thin plates, especially with less workability.

BACKGROUND OF THE INVENTION

Recently, from standpoint of saving natural sources and energy, small sizings and high efficiency of electromagnetic or electronic parts have been demanded, and soft magnetic property, especially Si steel sheets having excellent iron loss have been also required. It is known that soft magnetic properties of Si steel sheets are improved with increasing of addition of Si and exhibit the maximum permeability at about 6.5 wt %, and since natural electric resistance is high, the iron loss is made small. In this kind of steel sheets, if the Si content is less than 4.0 wt %, workability is abruptly worsened, and therefore it has been impossible to produce high Si steel sheets in industrial scales by the rolling process, but it has been found that the warm rolling could be performed on the thin steel sheets through studies.

However, ordinarily used rolling facilities could not secure bending deformation of the coil or temperatures of the materials, and are difficult to roll the high Si steel sheets. For example, Japanese Patent Application Laid-Open No.135,407/86 proposed a facility protecting from an uncoiling reel to first rolling stands with a warming wall, but this facility could not prevent cracks by bending at the deflector rolls or by rolling.

This invention has been developed in view of problems involved with the prior art, and is to provide a warm rolling facility which may carry out the rolling efficiently without causing cracks in thin steel sheets with less workability.

DISCLOSURE OF THE INVENTION

For accomplishing this object of the invention, the strip is subjected to reverse rollings between tension reels, while it is always maintained at determined temperatures, whereby the facility could prevent cracks or breakages by bending and working. The facility is constructed with a rolling machine, tension reels disposed respectively at an inlet side and an outlet side of the rolling machine, deflector rolls between each of the tension reels and the rolling machine. The tension reel is positioned in a warming furnace having a heating means, and the rolls and the deflector rolls are provided with heating means for the rolls. Further, the rolling machine is provided at the inlet and the outlet with heating apparatuses for the strip.

In this rolling facility, the strip is undertaken with the reverse rollings, and in a case of high Si steel sheet, the hot rolled coil of 2 mm thickness is ordinarily rolled to thickness of about 0.5 mm. The rolls are preheated about 200° C. (surface temperature) by heating means, and the defector rolls are also always preheated at about 200° C. (surface temperature) by heating means. The strip coil is kept at the temperatures between about 300° and 600° C. in the warming furnace. The strip which is uncoiled from one of the tension reels and sent from the warming furnace, passes the deflector rolls and is rolled. Since the deflector rolls are heated, the strip passing thereon is avoided from decreasing of temperature, so that the strip is checked from bending or breakage at the deflector rolls. The strip passing the deflector rolls is heated for securing the temperature of the strip to be rolled and goes into the rolling machine. Since the rolls are preheated, the strip is controlled to the minimum from escaping of the temperature at the rolls. The strip from the rolls is heated by the heating means disposed at the outlet of the rolls, and passes the heated deflector rolls and is coiled by another tension reel within the warming furnace. The strip is heated and maintained at the temperatures about from 200° to 600° C., and thus the rolling is repeated on the strip to reduce it to a thin sheet.

The strip is always maintained above the determined temperature (for example, more than 200° C.) during the reverse rolling, and the rolling is carried out as exactly avoiding crackings, breakages by the bending or the working at the tension reels, the deflector rolls and the rolling parts.

In the rolling of the high Si steel sheet, the strip is kept heated between each passes of the reverse rolls in warming furnace, so that recovery treatment is made between the passes and the maximum permeability is improved. That is, strain caused in the steel structure during the rolling is released moderately by the heating treatment at low temperatures in that the strip is kept heated within the warming furnace, and the coherent structure of the final product is changed by repeating causing of the strains in the steel structure and releasing of the strains, and as a result, the magnetic property is improved.

MOST PREFERRED EMBODIMENT FOR PRACTICING THE INVENTION

The invention will be explained with reference to embodiment shown in the attached drawings.

Figure 1:
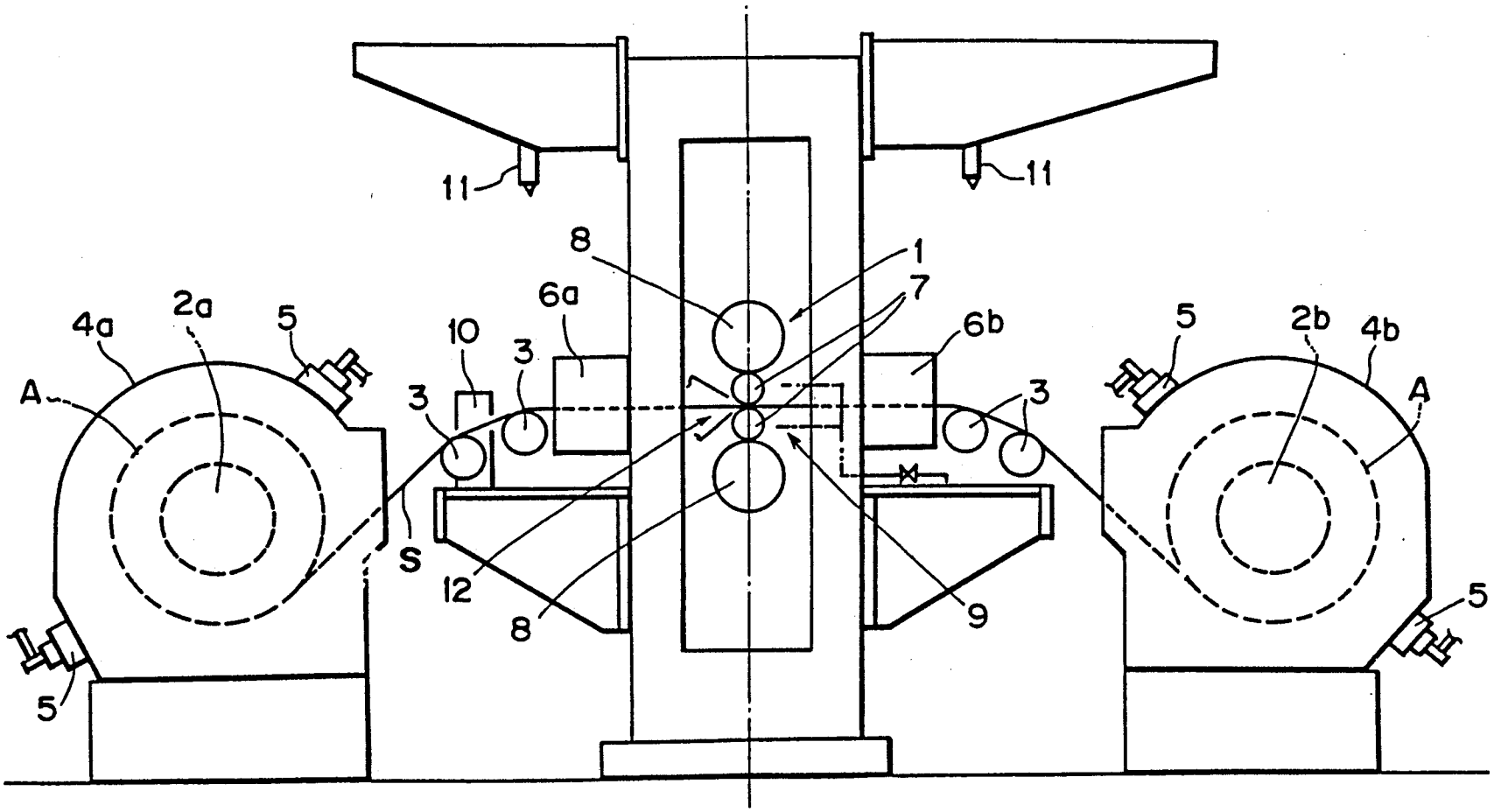
FIG. 1 is an explanatory view showing one example of the invention.

FIG. 1 shows one embodiment of the invention where a rolling facility is provided with a rolling machine 1, tension reels 2*a*,2*b* disposed at an inlet and an outlet thereof, and deflector rolls 3 positioned between each of the tension reels and the rolling machine.

The tension reels 2*a*,2*b* are positioned in warming furnaces 4*a*,4*b* having heating means. Each of the warming furnaces 4 is constructed as a gas furnace having a heating burner 5. As the heating means, appropriate ones may be used.

Heating apparatuses 6*a*,6*b* are provided at the inlet and the outlet of the rolling machine 1 for heating a running strip. As the heating apparatus, a heating furnace may be used which has a gas furnace (e.g., C gas furnace), an electric radiant heater or radiant tubes.

The deflector rolls 3 are positioned by two at the inlet and the outlet of the rolling machine. Each of the deflector rolls 3 is provided with a heating means, and in the present embodiment, the deflector roll is allowed to pass an oil therewithin at high temperature. As other heating means, such may be employed which is disposed with a burner directly heating the surface of the roll, or housed with an electric heater within the roll. Number of the deflector rolls gives influences to bending degree of the strip, and more than one are disposed in accordance with diameters of rolls or positioning conditions of the rolls.

The rolls 7 are provided with heating apparatuses for preheating the rolls, and in this embodiment, heating burners 9 stand against the vertical rolls 7. It is possible to compose a structure, as the heating means therefor, nozzles for supplying the oil at high temperature stand against back-up rolls 8 for preheating rolls 7 via the back-up rolls 8.

The numeral 10 designates a thickness measuring instrument, 11 designates thermometers, and 12 a lubricating grease supply.

The rolling machine 1 of this embodiment has four rolls, and others may be used as five, six rolls or planetary rolling machine, and a reverse rolling machine is not only one stand bu also plural stands. In the plural stands, the heating apparatuses are positioned at the inlet and the outlet of each of the rolling machines, thereby to carry out the rolling operation efficiently.

According to the above mentioned rolling facility, the strip coil (A) within the both warming furnaces *4a,4b* is normally maintained at the temperatures of 200° to 600° C., and each of the deflector rolls 3 is always heated to keep the temperatures of around 200° C. on the surface. The rolls 7 is preheated or heated to be around 200° C. on the surface.

The strip (S) at about 200° to 600° C. uncoiled from one of the tension reels 2 is bent by the deflector rolls 3 and sent to the rolls 7. Since the deflector rolls 3 are heated at about 200° C., the strip (S) runs as kept at least this temperature without causing breakage. The strip (S) is introduced instantly into the heating apparatus *6a* and heated to the rolling temperature, and reduced in thickness by the rolling machine 1. Since the rolls are heated or preheated, the strip is also here prevented from escaping of the temperature. The rolls are not necessarily heated always, and for example, it is possible to preheat the strip fully at a beginning step so as to avoid the strip from decreasing of the temperature, and maintain the rolls at the determined temperature by heat conductivity from the strip.

The rolled strip (S) is introduced instantly into the heating apparatus *6b* of the outlet and heated, and passes the deflector rolls 3 heated on the surface at about 200° C. as stated above, and coiled to the tension reel *2b* in the warming furnace *4b*. The strip (S) is rolled reversely between the tension reels *2a,2b* to a determined thickness.

Figure 2:
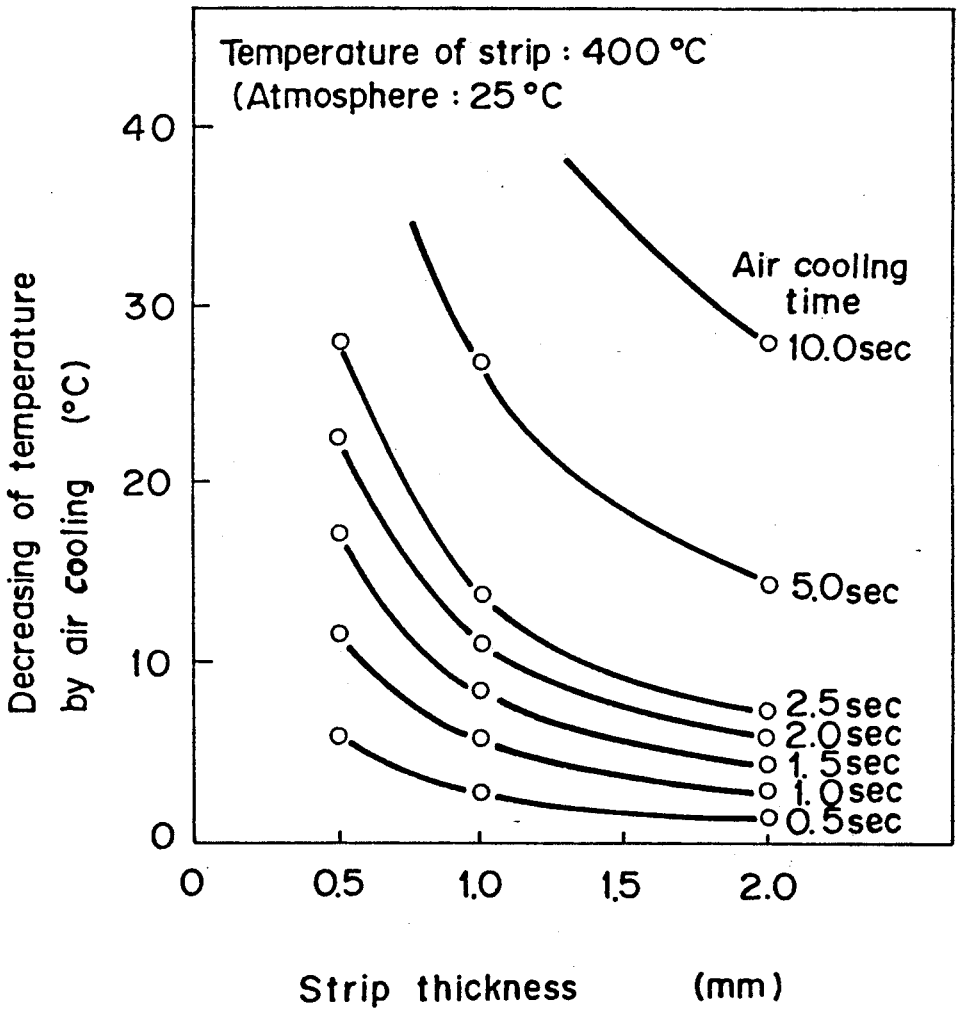
FIG. 2 is a diagram showing air cooling of temperature in accordance with thickness of a strip.
Figure 3:
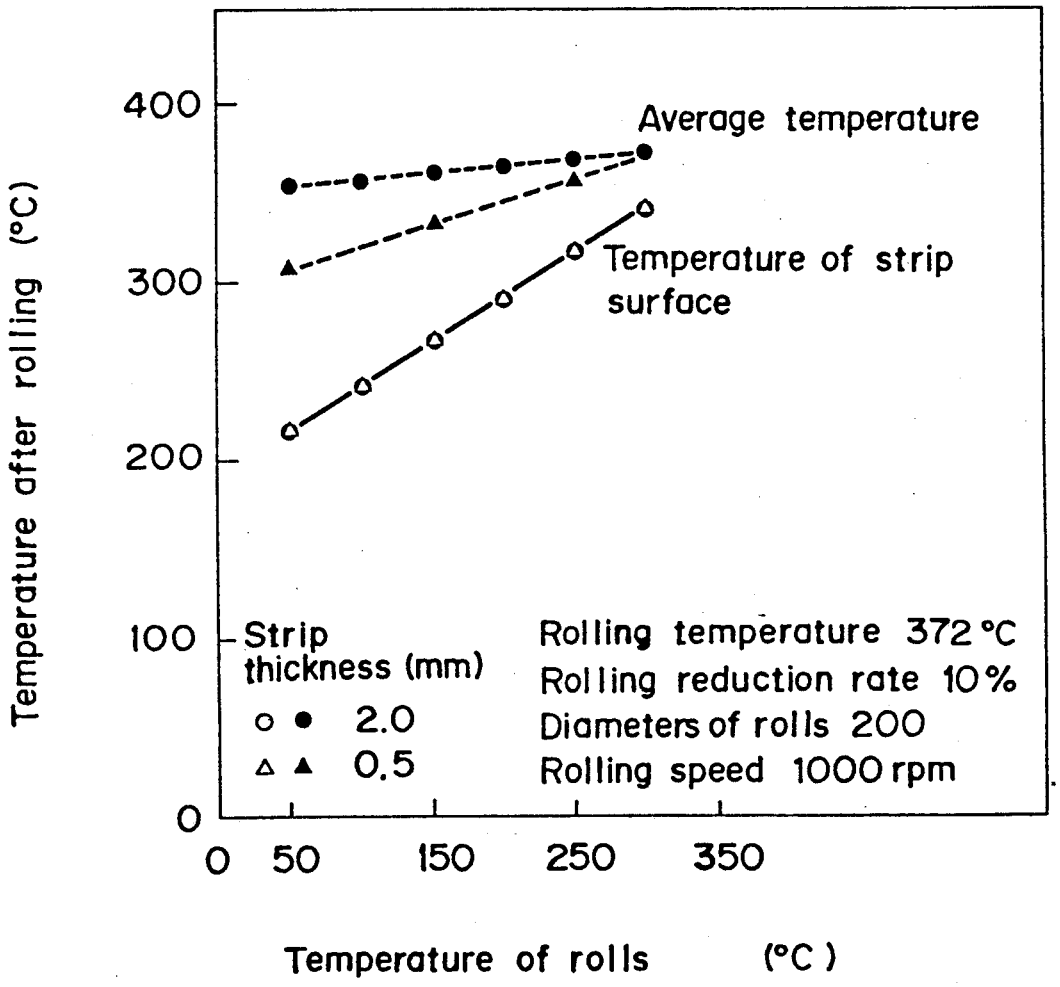
FIG. 3 is a diagram showing decreasing of temperature of the strip by contacting the rolls during operation, in relation with the temperature of the surfaces of the rolls and the temperature after rolling the strip.

FIG. 2 shows the decreasing of the temperature by the air cooling (decreasing from the temperature of 400° C. of the strip in the atmosphere of 25° C.) in response to the strip thickness. The temperature largely decreases in the thin strip. If the strip were rolled without the heating means between the tension reels, the warming condition could not be kept. FIG. 3 is a diagram showing decreasing of temperature of the strip by contacting the rolls during the rolling operation, in relation with the temperature of the surfaces of the rolls and the temperature after rolling the strip. The strip is prevented from decreasing of the temperature effectively by maintaining the roll surface at the determined temperature.

When the high Si steel strip is subjected to the reverse rolling and if the strip (S) is maintained for a determined time (normally 1 to 10 min.) in the warming furnaces *4a,4b* between each passes, the recovery treatment between the passes is carried out (the heating treatment at low temperatures of 300° to 600° C). Strain caused in the steel structure during the rolling by the recovery treatment between the passes is released moderately, and the coherent structure of the final product is improved in the magnetic property by repeating causing of the strains in the steel structure and releasing of the strains.

Each of the rolls 7 is supplied with a heat resistant lubricating grease (for example, the grease having an ignition point of more than 300° C.) from a lubricating grease supply 12.

When a supply device of an oil at high temperature is provided as a heating means of the rolls, the back-up rolls 8 are applied with the oil of more than 200° C. for preheating the rolls 7 via preheating of the back-up rolls.

According to the present invention, since the reverse rolling can be undertaken while the strip is always maintained above 200° C. at which the bending or rolling reduction is loaded to the strip, the rolling can be performed on even such steel strips with less workability containing more than 4.0 wt % Si, without causing cracks or breakage in the strip.

In the case of the high Si steel, the strip is subjected to the recovery treatment between the passes by keeping warmed between each passes of the reverse rolling, thereby to improve the magnetic property of the final product.

INDUSTRIAL APPLICABILITY

The present rolling facility may be applied to rolling of thin plates with less workability such as high Si steels.

What is claimed is:

1. A warm rolling facility for silicon steel strip coils, comprising in combination a rolling machine 1 having an inlet and an outlet and rolls 7 and a heating burner 9 adapted to pre-heat said rolls 7, at least two warming furnaces *4a,4b*, a tension reel *2a,2b* supported within each warming furnace and disposed at said inlet and outlet, respectively, a plurality of individual deflector rolls 3 provided with deflector roll heating means and disposed outside of said warming furnaces and between the tension reels and the rolling machine, heating means *6a,6b* disposed at said inlet and outlet, respectively, for heating a passing steel strip, wherein said heating means *6a,6b* and said deflector roll heating means comprise a plurality of components generating heat, which components are arranged in closely spaced series throughout the passage traversed by the steel strip between said tension reels for the purpose of maintaining said steel strip at a predetermined temperature throughout said passage.

2. The facility as claimed in claim 1, wherein the roll heating burner 9 directly heat the rolls 7.

3. The facility as claimed in claim 1, wherein the roll heating burner 9 indirectly heat the rolls 7 via back-up rolls 8.

4. The facility as claimed in claim 1, 2, or 3 provided with the rolling machines having a plurality of stands.

5. The facility as claimed in claim 1, 2, or 3 wherein the heating means for the deflector rolls are constructed for flowing heating medium within the rolls.

6. The facility as claimed in claim 1, 2, or 3 wherein the heating means for the deflector rolls heat the rolls outside thereof.

7. The facility as claimed in claim 1, 2, or 3 provided with lubricating grease supply to vicinity of the rolls.

8. A method of rolling a travelling silicon steel strip by carrying out reverse rollings between first and second tension reels disposed in first and second warming furnaces, respectively, while maintaining said strip at a predetermined temperature by continuously performing the steps comprising:

uncoiling said strip from said first tension reel as said strip leaves said first warming furnace while keeping said strip heated in the first warming furnace;

deflecting the path of said strip with a first deflector roll maintained at a predetermined temperature;

further deflecting the path of said strip with a second deflector roll maintained at a predetermined temperature;

heating said strip prior to said strip entering a rolling machine;

rolling said strip by means of preheated rolls in said rolling machine;

heating said strip after said strip exits said rolling machine;

deflecting the path of said strip with a third deflector roll maintained at a predetermined temperature;

further deflecting the path of said strip with a fourth deflector roll maintained at a predetermined temperature; and coiling said strip on said second tension reel in said second warming furnace and keeping said strip heated in said second warming furnace.

9. The method of claim 8, wherein said predetermined temperature of the steel strip is not lower than 200° C.

10. The method of claim 8 or 9, comprising reverse rolling said steel strip between the first and second tension reels and keeping said strip heated in the warming furnace between each pass of the reverse rolls, whereby recovery treatment is made between the passes.

* * * * *